United States Patent [19]

Zearfoss, Jr.

[11] 3,955,374

[45] May 11, 1976

[54] REFRIGERATION APPARATUS AND METHOD

[76] Inventor: Elmer W. Zearfoss, Jr., 929 Magee Ave., Philadelphia, Pa. 19111

[22] Filed: Oct. 23, 1974

[21] Appl. No.: 517,141

[52] U.S. Cl. ..... 62/197; 62/113; 62/511

[51] Int. Cl.[2] ..... F25B 41/06

[58] Field of Search ..... 62/511, 113, 197, 513

[56] References Cited

UNITED STATES PATENTS

| | | | |
|---|---|---|---|
| 2,393,854 | 1/1946 | Carpenter | 62/511 |
| 3,285,032 | 11/1966 | Vanderlee | 62/511 X |

*Primary Examiner*—William E. Wayner
*Attorney, Agent, or Firm*—Harry W. Hargis, III

[57] ABSTRACT

Refrigeration apparatus comprising a refrigerant compressor, a condenser, an evaporator, a suction line connecting said evaporator to the intake of the compressor, and a capillary tube restrictor effective to feed refrigerant from the condenser to the evaporator. Refrigerant flow control means is interposed the capillary tube and the evaporator, with a portion of the flow control means disposed in heat exchange relation with the evaporator outlet. The flow control means further includes a diverter conduit for a portion of the liquid refrigerant being fed to the evaporator and affording heat exchange of said portion with refrigerant flowing from the condenser to the evaporator.

In operation, an increase in superheat sensed by the control means through its heat exchange relation with the evaporator outlet - an indication of a starved evaporator - will cause the control means to effect liquid refrigerant flow through the diverter conduit, where it will operate by way of the described heat exchange to subcool liquid refrigerant flowing through the capillary tube restrictor from the condenser to the evaporator, thereby increasing the refrigerant mass-flow rate and restoring the evaporator to its non-starved operating condition.

18 Claims, 11 Drawing Figures

REFRIGERATION APPARATUS AND METHOD

BACKGROUND OF THE INVENTION

This invention relates to refrigeration, and more particularly to improvements in both apparatus and operating aspects of refrigeration systems of the vapor-compression type utilizing capillary tube restrictors as the throttling means.

Capillary tube restrictors are widely used in refrigeration systems to meter the flow of liquid refrigerant between the condenser and the evaporator. The flow characteristics of an overall system are basically a function of the capillary tube dimensions, i.e., length and inside diameter, in combination with dimensions and performance of other refrigerant circuit components of the system. Optimum balance between mass-flow rate of refrigerant capable of being handled by the capillary tube restrictor and system refrigerant flow-rate may be resolved to a line function of operating conditions. Deviations from a preferred line function can be tolerated, for example in the field of household refrigeration appliances using relatively low capacity, fractional horsepower compressors.

Heretofore, in larger capacity units, where high efficiency and wide variations in operating conditions must be dealt with, capillary tube restrictors have met with limited success. Instead, resort has been had to the more costly thermostatically controlled expansion valve as a metering device. Control of such a valve is a function of evaporator loading as determined by the evaporator superheat temperature by a sensing element operably coupled with means effective to modulate the rate of flow through the valve.

It is an objective of my invention to provide a refrigeration system with improved capillary tube restrictor means overcoming the above briefly described shortcomings of such restrictors and achieving the operating flexibility afforded by more costly thermostatically controlled expansion valves.

It is a further and more general objective of the invention to provide refrigeration apparatus with improved capillary tube restrictor means affording efficient operation over a variety of operating conditions.

It is a further objective of the invention to provide means for improving operation of a refrigeration system of otherwise conventional design.

It is also a objective of the invention to provide a novel and improved method of operation of a refrigeration system utilizing a capillary tube restrictor as the metering device.

SUMMARY OF THE INVENTION

In achievement of the foregoing as well as other objectives, the invention contemplates improvements in both apparatus and operating aspects of refrigeration systems of the type comprising refrigerant evaporator means, suction line means, compressor means, condenser means, and capillary tube restrictor means disposed in conventional series refrigerant flow communication, in the order stated. Improvement lies in refrigerant flow rate control means, operable to modulate refrigerant flow through the restrictor means by controlling subcooling of such refrigerant in response to changes in the superheat temperature of refrigerant leaving the evaporator.

The improvement comprises, in a preferred aspect thereof, first and second conduit means having upper and lower portions in fluid flow communication, said first conduit means being provided with inlet port means through which liquid refrigerant from said restrictor means is fed directly to said first conduit means, said first conduit means also being provided with refrigerant outlet port means adapted to feed liquid refrigerant to said evaporator means, said second conduit means also being adapted for liquid outflow through passage means disposed at a level above the level of said first conduit outlet port means, and means affording heat exchange relation between refrigerant flowing through said capillary tube restrictor means and liquid refrigerant caused to flow from said second conduit means through said passage means, and means operable to volatilize refrigerant in said second conduit means to effect the recited flow through said passage means in response to superheat of refrigerant flowing from said evaporator means.

The manner in which the foregoing as well as other objectives and advantages of the invention may best be achieved will be more fully understood from a consideration of the following description taken in light of the accompanying Drawing.

DESCRIPTION OF THE SEVERAL EMBODIMENTS

Figure 1:
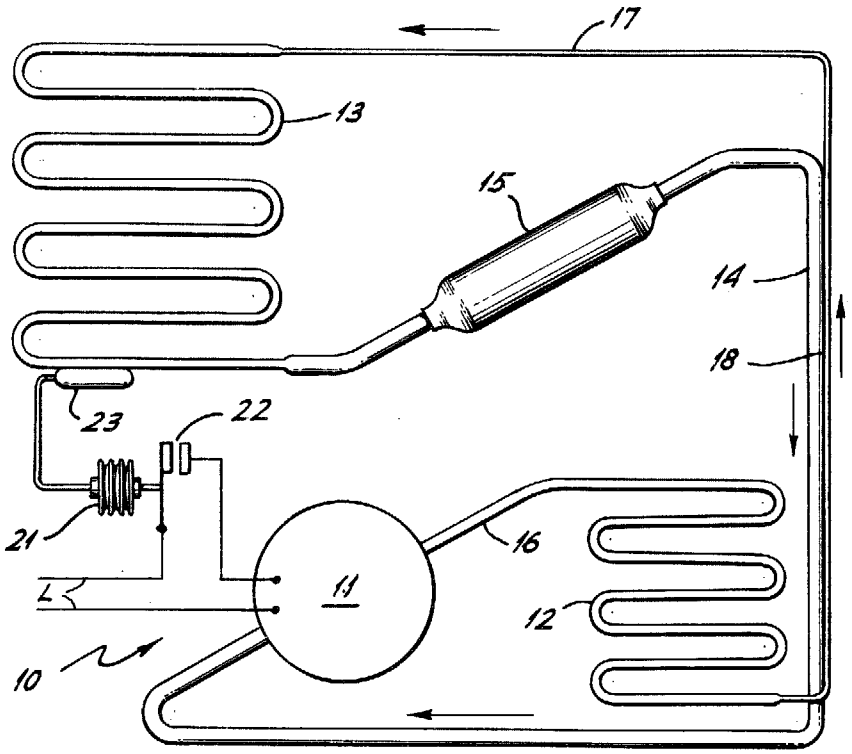
FIG. 1. (PRIOR ART)
FIG. 1 is a diagrammatic view of a prior art refrigerating system of a general type over which the invention is an improvement.

With more detailed reference to the drawing, and in order better to understand the advantages afforded by my invention, there is illustrated in FIG. 1 a typical prior art refrigeration system 10 of the capillary tube restrictor type comprising a refrigerant compressor 11, a condenser 12, and an evaporator 13 connected in the usual series circuitry. Evaporator 13 is connected to compressor 11 by a suction line 14 and a refrigerant accumulator 15 located adjacent the outlet of evaporator 13. As is well known in the art, accumulator 14 serves to store excess liquid refrigerant in the system and to limit floodback through the suction line during compressor start-up. A discharge line 16 connects compressor 11 to condenser 12, and a capillary tube restrictor 17 connects the outlet of condenser 12 to the inlet of evaporator 13. In accordance with known practice, a portion of capillary tube restrictor 17 is disposed in heat exchange relation with a portion of suction line 14, as is seen generally at 18. In some instances accumulator 15 and heat exchange 18 are not included.

Operation of compressor 11, which conveniently is of the motor-compressor type, is under the control of switch 22 of a bellows-actuated thermostat 21 having temperature sensing bulb 23, which switch 22 is in series, electrically, with line L and the drive motor of compressor 11.

Although there has been shown no medium to be cooled by evaporator 13, as will be the case with the embodiments of the invention to be described in what follows, it will be understood that the evaporator in diverse applications may be disposed and adapted to cool perhaps an insulated enclosure, an ordinary room or a water cooler, etc.. The operating limits, i.e., cut-in and cut-out temperatures, of thermostat 21 are selected to afford the desired operating temperatures in a given application.

Figure 2:
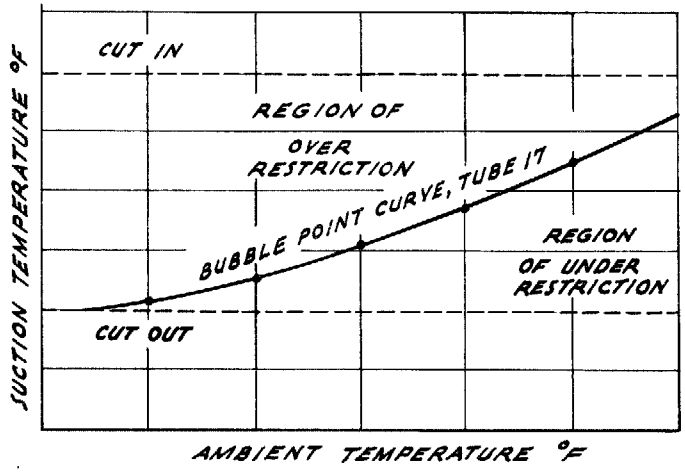
FIG. 2. (PRIOR ART)
FIG. 2 is a chart showing performance characteristics afforded by the typical prior art refrigeration system of FIG. 1.

Reference is made to FIG. 2 for a brief discussion of the operation of the above described prior art refrigeration system utilizing a capillary tube restrictor, looking to a full appreciation of the manner in which the disclosed and claimed systems embodying the present invention overcome disadvantages of a typical prior art system. In FIG. 2, a curve has been plotted for the optimum flow rate of refrigerant through a capillary tube restrictor 17, over a range of suction temperatures as the ordinate and range of ambient temperatures as the abcissa. Optimum flow rate is considered to occur at the so called "bubble point," i.e. when gaseous refrigerant first enters the restrictor from the condenser, and the optimum flow-rate curve has been identified as "Bubble Point Curve, Tube 17".

In a given system, a given capillary tube restrictor affords optimum refirgerant flow from the condenser to the evaporator only at one suction temperature value for a given ambient temperature. Hence, a system cycling between controlled upper and lower cut-in and cut-out temperatures, respectively, will range above and below optimum values defined by the capillary tube restrictor bubble point curve. When the operating suction temperature is at a value above the curve, the impedence of the capillary tube restrictor is too great, causing refrigerant to back-up in the condenser with consequent starving of the evaporator. This inordinately lowers the suction temperature, reducing the heat absorbing capacity and operating efficiency of the system.

When the suction temperature ranges below the optimum flow rate curve, the capillary tube restrictor does not afford enough impedence, resulting in flow into the restrictor of both liquid and some gaseous refrigerant. The gas moving through the system contributes nothing to the refrigerating effect, and in fact represents a loss. As the suction temperature is lowered further these losses increase, sometimes intolerably. Summarizing, a given capillary tube restrictor per se, in a given system, in a given ambient temperature will have but one suction temperature at which optimum flow rate, hence optimum system performance, can be realized.

Figure 3:
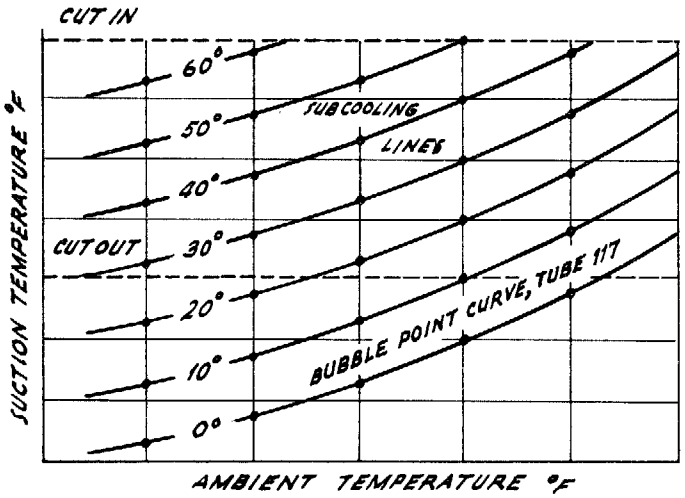
FIG. 3 is a chart, similar to FIG. 2, showing improved performance characteristics afforded by systems embodying my invention and illustrated in the ensuing Figures.

To overcome the above described disadvantages, I have proposed an improved system which will operate in the range illustrated in FIG. 3, which range for the selected capillary tube restrictor is identified as "Bubble Point Curve, Tube 117." The restrictor is selected to exhibit over-restriction for the total operating range shown. Marked also on FIG. 3 are subcooling lines for the same restrictive tube, derived from the established fact that subcooled liquid refrigerant entering the tube 117 flows at a greater rate and hence operatively affords the bubble point characteristics of a larger restrictive tube size (with zero degrees subcooling). The greater the subcooling, the greater the flow capacity, and, by way of example, at 60° subcooling the selected over-restrictive tube allows a flow rate adequate to satisfy even the high evaporator demand at the cut-in range of the system illustrated. Stated another way, when compared to the restrictive tube represented by curve 117, each progressive superheat curve identified on FIG. 3 is equivalent to the bubble point performance of a tube of correspondingly less physical restriction (again functioning without subcooling). It only remains now to describe how this basically over-restrictive tube at "Bubble Point Curve, Tube 117" is selectively subcooled to extend its flow capacity to the upper limits of cut-in, whenever the need arises to combat excessive evaporator superheat. My novel design, to be described in what follows, assures that sufficient liquid exists in the condenser at the entrance to the capillary tube restrictor, always to afford entrance of substantially all liquid thereto. I propose to simultaneously achieve operation with both high evaporator capacity and an optimum flow rate by subcooling liquid refrigerant flowing through the capillary tube restrictor of accordance with the degree of superheat of refrigerant flowing from the evaporator.

Figure 4:
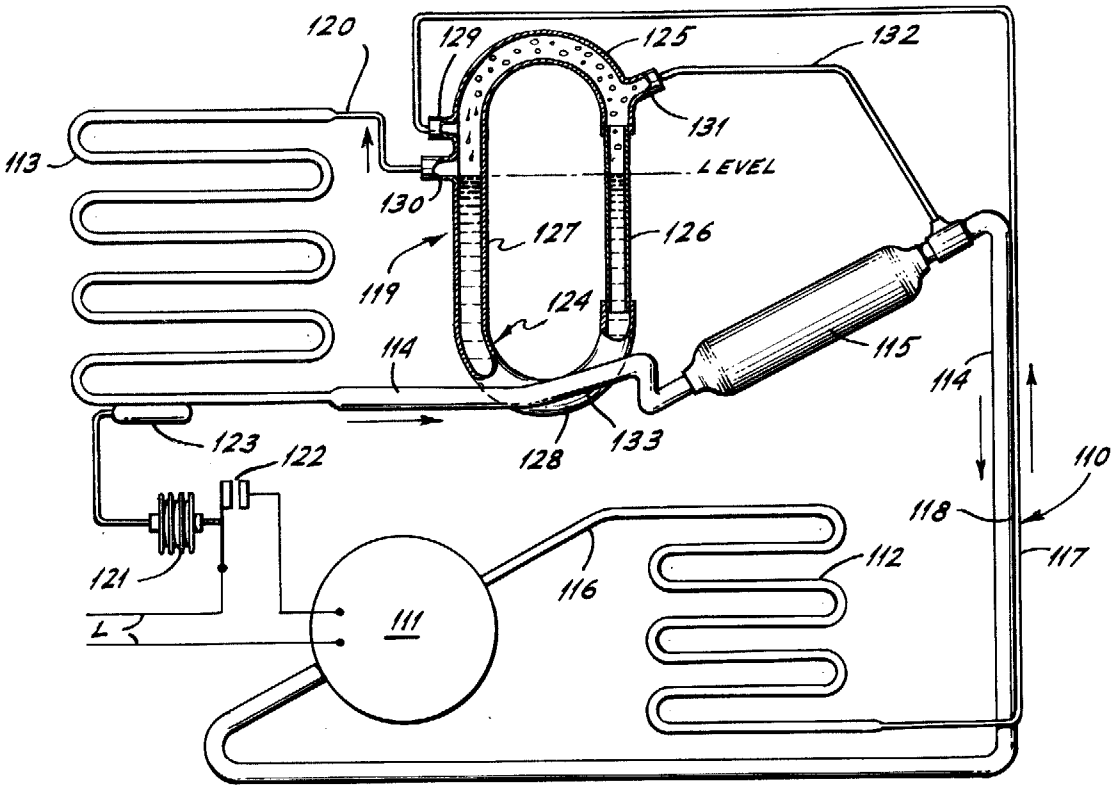
FIG. 4 is a partially sectioned diagrammatic view of a refrigerating system embodying one form of the invention.

My proposed system, in the embodiment seen at 110 in FIG. 4, comprises compressor 111, condenser 112, and an evaporator 113, connected in the usual series flow circuit. Evaporator 113 is connected to compressor 111 by a suction line 114 and a refrigerant accumulator 115 disposed adjacent the outlet of evaporator 113. A discharge line 116 connects compressor 111 to condenser 112, and a conduit including a capillary tube restrictor 117 connects the outlet of condenser 112 to a novel control device or apparatus designated generally by the numeral 119. Apparatus 119 is connected through a restrictor 120, to the inlet of evaporator 113. A portion of capillary tube restrictor 117 is disposed in heat exchange relation with a portion of suction line 114, shown generally at 118. Operation of compressor 111, conveniently of the motor-compressor type, is under the control of the switch 122 of a bellows actuated thermostat 121 having a temperature sensing bulb 123, which switch 122 is in series with line L and the drive motor of compressor 111.

In particular accordance with the invention, control apparatus 119, for achieving the mode of operation described in connection with FIG. 3, comprises a configuration of tubular members featured by a closed loop of tubing 124 having a first tubular section defining a right-hand conduit portion 126 and a second tubular section defining a left-hand conduit portion 127 in communication through an upper loop 125 and a lower loop 128. A mixture of refrigerant liquid and flash gas is fed from capillary tube restrictor 117 to an inlet port 129 in left-hand conduit portion 127. A refrigerant outlet port 130 in left-hand conduit portion 127 is connected in fluid flow communication with restrictor 120 leading to evaporator 113. Another refrigerant outlet port 131 is provided in right-hand conduit portion 126, at a level above outlet port 130, and is disposed in fluid flow communication with restrictor 132 leading to suction line 114 in a region intermediate accumulator 115 and heat exchanage 118. Further to the invention, lower loop 128, in the region toward right-hand conduit portion 126, is disposed in heat exchange relation, as seen at 133, with a suitably formed portion of the evaporator outlet.

Operation of compressor 111 under the control of thermostat 121 is cyclic, in accordance with cut-in and cut-out temperatures shown in FIG. 3. Assume now that in the course of compressor operation evaporator 113 tends toward starvation, while the level of liquid in control apparatus 119, as seen in FIG. 4, is such that port 130 allows flow of liquid refrigerant through restrictor 120 into evaporator 113, and port 131 allows only gaseous refrigerant flow to suction line 114.

Figure 5:
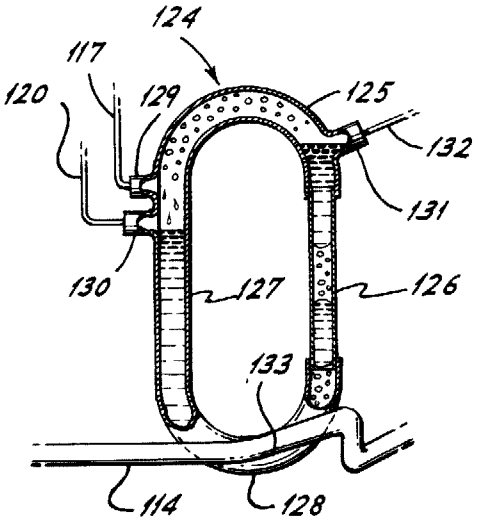
FIG. 5 is a fragmentary view of a portion of the refrigerating system seen in FIG. 4, and illustrating an operational feature thereof.

As evaporator 113 becomes increasingly starved, and with reference to FIG. 5, the superheat temperature of refrigerant leaving the evaporator will increase the heat flow into righthand conduit portion 126 of loop 124 by virtue of heat exchange 133 with lower loop 128. This action volatilizes refrigerant in lower loop 128 and conduit portion 126 thereby vapor-lifting the right-hand column of liquid refrigerant to the level of outlet port 131. Liquid refrigerant then flows from port 131 through bypass restrictor 132 and expands into suction line 114. This refrigerant renders refrigerant relatively colder in the suction line at heat exchange 118, thereby sub-cooling liquid refrigerant flowing through capillary tube restrictor 117. The flow rate in restrictor 117 thus is increased for reasons explained hereinabove and over a period of operation under this condition the evaporator has its supply of refrigerant restored. Restoration of refrigerant reduces the evaporator superheat, resulting in cessation of the vapor lift and return of the system to the original flow rate until the evaporator again becomes starved.

In achievement of the described operation I have kept low the combined impedance of restrictors 120 and 132 and have sized restrictor 132 to meet the subcooling load that capillary tube restrictor 117 imposes on heat exchange 118. It will be noted that conduit portion 126 of apparatus 119 is of reduced cross section to enhance the efficiency of the vapor lift afforded by energy derived from heat exchange 133. Although accumulator 115 has been included in the present system, its presence is optional according to system application.

Figure 6:
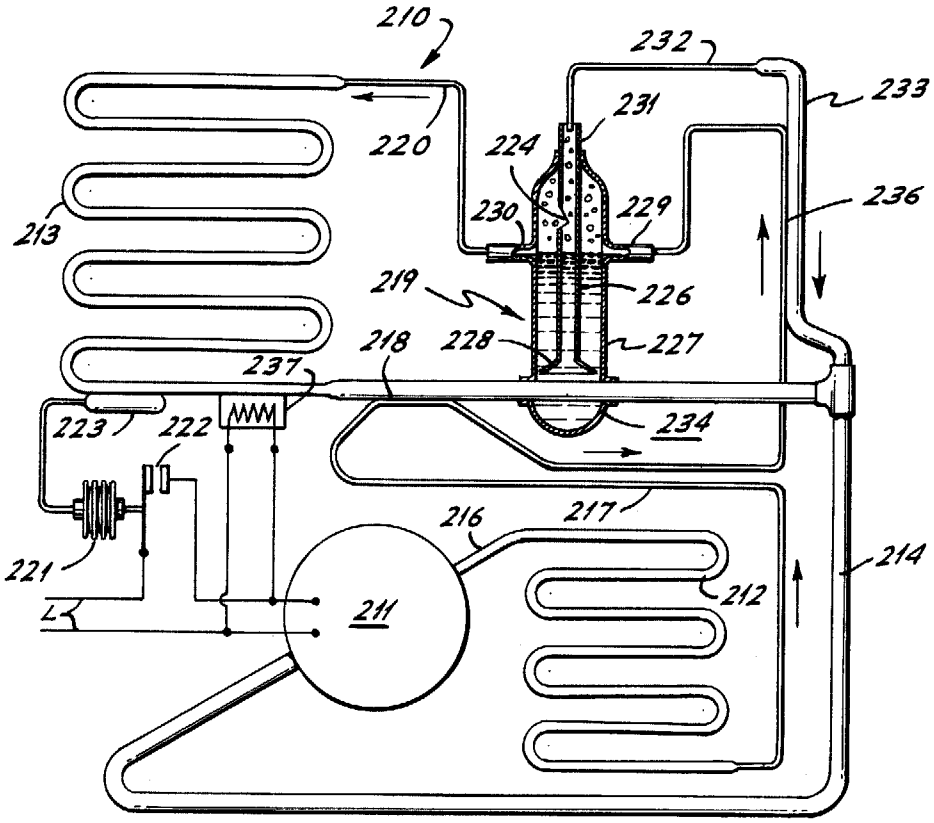
FIG. 6 is a partially sectioned, diagrammatic view of a refrigerating system embodying another form of the invention.

Another embodiment of the invention is seen in FIG. 6, and is illustrative of the adaptability of my improved control device 219 both to construction by a different technique and to a system 210 lacking the conventional capillary tube restrictor-to-suctionline heat exchange relation. More particularly, system 210 comprises motor-compressor 211, condenser 212, and evaporator 213. A suction line 214 connects the evaporator outlet to motor-compressor 211 and a discharge line 216 connects the motor-compressor to the inlet of condenser 212. Conduit means including a capillary tube restrictor 217 leads from the outlet of condenser 212 to control device 219 which includes an upstanding inner conduit portion 226 and an upstanding outer conduit portion 227, each in fluid flow communication at their lower ends. Inner conduit portion 226 includes a lower, bell-shaped section 228, a laterally presented port 224 providing open communication between upper regions of conduit portions 226 and 227, and an outlet port 231 in an upper region thereof. A portion of the evaporator outlet extends through the lower region of conduit portion 227 at 234 below bellshaped conduit section 228, in provision of heat-exchange relation between the superheated gas leaving the evaporator and liquid refrigerant in conduit portion 227. Capillary tube restrictor 217 communicates with an inlet port 229 provided in conduit portion 227. An outlet port 230 provided in conduit portion 227, at a level below port 224 of conduit portion 226, is connected to the inlet of evaporator 213 by a fluid flow restrictor 220. Outlet port 231 is connected by a fluid flow restrictor 232 to suction line 214, via a tube section 233 disposed in heat exchange relation, as seen at 236, with the main capillary tube restrictor 217. A portion of the main restrictor 217 also is connected in heat exchange relation at 218 with the outlet of evaporator 213, but upstream of the evaporator outlet heat exchange 234 with conduit portion 227.

Cyclic operation of compressor 211 is afforded by a bellows-actuated control 221 including a temperature sensing bulb 223 and a switch 222 connected in series electrical circuit with an A.C. energy source, such as line L, and the motor of compressor 211. Further to the control apparatus, an auxiliary heater 237, in parallel with the compressor motor, thermally supplements heat exchange 218. These two latter described heat exchange relationships serve to bias and/or intensify the degree of refrigerant superheat developed naturally in the evaporator 213.

In the embodiment of the invention shown in FIG. 6, closure of switch 222 affords operation of motor-compressor 211 accompanied by flow of liquid/gaseous refrigerant from capillary tube restrictor 217, through port 229 into outer conduit portion 227. Liquid refrigerant then flows through port 230 and restrictor 220 into evaporator 213. Flash gas in conduit 227 is free to flow into port 224, upwardly through conduit portion 226 and outlet port 231 into diverter restrictor 232 and tube section 233, which returns the gas to suction line 214 for flow into the compressor intake. Under this transient condition of operation, the evaporator outlet temperature might be assumed only slightly above saturation, (i.e., slightly superheated) with little or no heat introduced to control device 219 through heat exchange 234 with the evaporator outlet.

Figure 7:
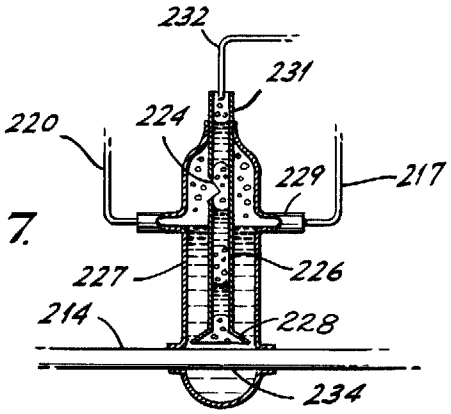
FIG. 7 is a fragmentary view of a portion of the refrigerating system seen in FIG. 6, and illustrating an operational feature thereof.

As a load condition may arise causing evaporator 213 to become starved, and a back-up of refrigerant in condenser 212 to develop due to over-restriction by the main capillary tube restrictor 217, the superheat temperature will rise at the evaporator outlet. This rise in temperature, given impetus by heater 237 and heat exchange 218, is then transferred via heat exchange 234 to liquid refrigerant in the lower region of conduit portion 227. As is seen in FIG. 7, this heat vaporizes refrigerant for flow to inner conduit 226 causing liquid flow upwardly through port 231, into diverter restrictor 232, and into tube section 233 and suction line 214, thence to compressor 211. This diverted, or bypassed refrigerant expands in tube 233, and, through the agency of heat exchange 236, subcools refrigerant in capillary tube restrictor 217. Refrigerant flow to evaporator 213 is then increased as heretofore described and evaporator superheat eventually reduced with consequent curtailment in heat supplied through heat exchange 234 to conduit portion 227. Such functional modes are cyclic and represent the basic operating dynamics of the embodiment seen in FIGS. 6 and 7.

Heat exchange 218 and heater 237 are optional design features to be employed where close control of evaporator superheat with minimum override is desired. Also optional is an accumulator (not shown) similar to that seen in FIG. 4, which can be inserted in the circuitry of FIG. 6 as need may arise.

Figure 8:
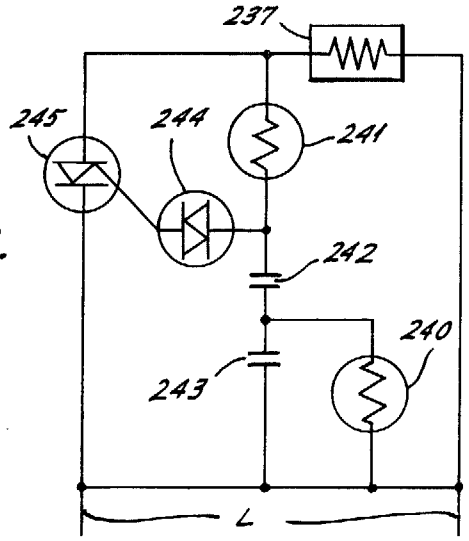
FIG. 8 is a view of a control for apparatus seen in FIGS. 6 and 7, and illustrating a modification contemplated by the invention.

FIG. 8 depicts a modified heater control circuit applicable to the embodiment shown in FIGS. 6 and 7, wherein the heater 237 of FIG. 6 is subject to solid state control circuitry. In the circuit illustrated, a thermistor 240 is oriented to sense the inlet temperature of evaporator 213, and a thermistor 241 is oriented to sense the evaporator outlet temperature. Energization of heater 237 is controlled by means including a solid state device 245 known in the trade as a TRIAC and disposed in series circuit with line L and heater 237. Firing of the TRIAC 245 is achieved by another solid state device 244 known in the trade as a DIAC and connected as shown in a circuit including the TRIAC 245, a pair of capacitors 242 and 243 and thermistor 241, each in series with one another while forming aa circuit in parallel with heater 237 and the TRIAC. Thermistor 240 is connected in parallel with capacitor 243 and functions to control the rate of attainment of firing voltage applied by DIAC 244 to TRIAC 245, and consequently the effective operating current applied to heater 237. Thermistor 240 is connected in series circuit with line L, capacitor 242 and thermistor 241. Energization of heater 237 is controlled by variations in resistance of thermistors 240 and 241.

When evaporator superheat increases, thermistor 241 increases in temperature relative to thermistor 240. Being thermistors with negative temperature coefficients of resistence, the imbalance resistance-wise is correspondingly inverse. In the circuit illustrated, this change causes the voltage across the condensers 242 and 243 to increase sufficiently during the A.C. power cycle, as derived from line L, to fire DIAC 244, thereby triggering TRIAC 245 into conduction and energizing heater 237. Energized heater 237 thus will activate the vapor lift in FIG. 7 subject to evaporator superheat controlling refrigerant flow in capillary tube 214 (FIG. 6) as heretofore described. It will be understood that heat exchanges 218 and 234 of FIG. 6 are optional, while heater 237 might be attached directly to tube 227 in provision of a sole source of thermal energy for control device 219 when FIG. 8 circuitry is utilized.

Figure 9:
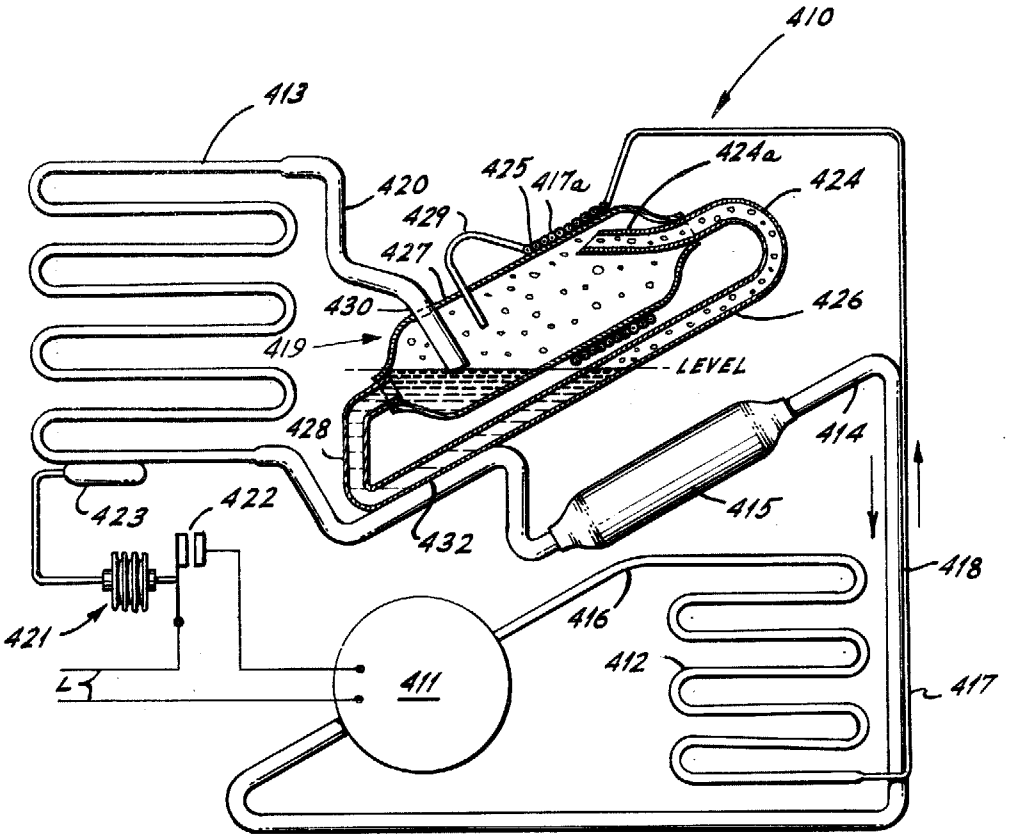
FIG. 9 is a partially sectioned, diagrammatic view of a refrigerating system embodying still another form of the invention.

A system embodying a further, and perhaps more simplified form of the invention, is seen at 410 in FIG. 9. System 410 includes a motor-compressor 411, a condenser 412, an evaporator 413, a suction line 414, and an accumulator 415 in the suction line. A discharge line 416 connects the motor-compressor 411 to the condenser 412, and a conduit comprising a main capillary tube restrictor 417 connects the condenser 412 to the inlet of evaporator 413 through the agency of a novel control means featured by device 419 to be described in detail. Suction line 414 and accumulator 415 connect the outlet of evaporator 413 to the motor-compressor 411. Portions of the suction line 414 and the main capillary tube restrictor 417 are disposed in heat exchange relation as seen at 418. Control means 419 includes a looped configuration of tubular conduit portions 426 and 427 having spaced, substantially parallel axes inclined to the horizontal. The latter angularity, while not critical, tends to optimize the performance of the device configuration as shown, when compared to a vertical orientation of such configuration. An upper loop portion 424 provides fluid flow communication between upper regions of conduit portions 426 and 427, and a lower loop portion 428 interconnects their lower regions. In further accordance with this embodiment, loop portion 424 has an extension 424A, angled slightly upwardly to direct fluid flow therefrom onto the inner walls of conduit portion 427. A section of loop portion 428 is disposed in heat exchange relation, as seen at 432, with the suction line 414 in the region of the outlet of evaporator 413.

An inlet port to conduit portion 427 is provided at 429. The tube 430 comprises the outlet port of conduit portion 427, and has its lower end disposed at a level below inlet port 429. A portion of capillary tubing 417A is disposed about conduit portion 427, in heat exchange relation therewith as seen at 425, which tubing 417A leads to inlet port 429. Tube 420 leads from outlet port 430 to the inlet of evaporator 413.

Completing the system is a bellows-actuated thermostat 421 having a temperature sensing bulb 423 and a compressor energizing switch 422 connected in series electrical circuit with a source of energy L and the motor of motor-compressor 411.

In operation, an elevation in temperature causes switch 422 to close, energizing motor-compressor 411. Gaseous refrigerant from evaporator 413 then is caused to flow through accumulator 415 and suction line 414 into compressor 411, where its pressure is raised, thence to flow outwardly to condenser 412. Liquified refrigerant flows into main capillary tube restrictor 417, section 417A and to inlet port 429 of device 419. Some of this liquid flashes into gas, filling upper regions of conduit portions 426 and 427 and upper loop portion 424. Liquid filling the lower regions, including lower loop portion 428, to a level reaching outlet port 430, flows outwardly thereof through tube 420 and into evaporator 413. Operation in this manner continues until such time as undue loading of evaporator 413 may occur (see FIG. 10) which will be accompanied by increase in the superheat temperature of gaseous refrigerant leaving the evaporator 413. This superheat is absorbed through heat exchange 432, as heat of vaporization by colder liquid refrigerant in lower loop 428 and conduit portion 426, causing liquid to become vapor lifted upwardly through loop portion 424 and its extension 424A onto inner walls of conduit portion 427. This liquid absorbs heat from relatively warmer refrigerant in coiled tubing 417A, subcooling the liquid refrigerant to increase flow from the restrictor to evaporator 413 via ports 429, 430, and tube 420. When the evaporator refrigerant supply has been restored, the superheat at heat exchange 432 is reduced to halt the vapor lift of liquid upwardly through conduit portion 426, thereby halting the substantial absorption of heat from coil 417A at heat exchange 425.

Figure 10:
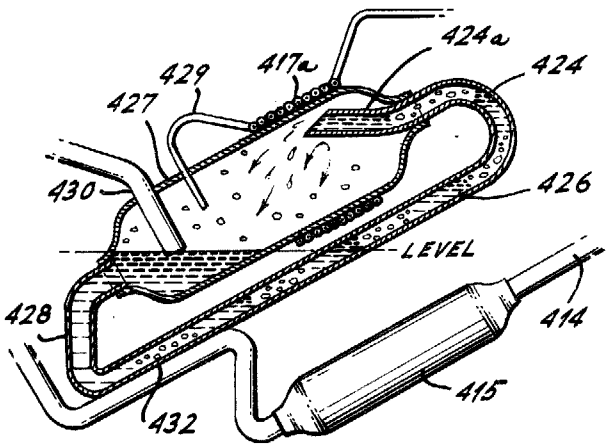
FIG. 10 is a fragmentary view of a portion of the refrigerating system seen in FIG. 9, and illustrating an operational feature thereof.

In the embodiment shown in FIGS. 9 and 10, heat exchange 418 and accumulator 415 could be omitted, and it is further contemplated that main capillary tube section 417 could be shifted downstream toward inlet port 429 and a non-restrictive tube interposed condenser 412 and tube 417.

Figure 11:
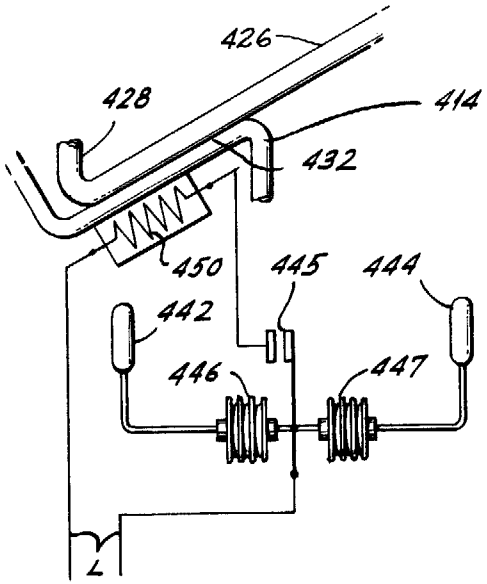
FIG. 11 is a view of a control for the apparatus seen in FIGS. 9 and 10, and illustrating a modification contemplated by the invention.

A further modified embodiment of the invention is seen in FIG. 11, wherein an auxiliary electrical heater 450 is disposed in heat exchange relation with tube 426 in proximity of heat exchange relation with tube 426 in proximity of heat exchange 432 of FIGS. 9 and 10. One side of heater 450 is connected to a source of energy L, and the other side is connected to the same source of energy L through a switch 445 under control of opposed bellows 446 and 447. Bellows 446 is in fluid flow communication with evaporator inlet temperature sensing bulb 442, and bellows 447 is disposed in fluid flow communication with evaporator outlet temperature sensing bulb 444.

In operation of the embodiment seen in FIG. 11, as applied to FIGS. 9 and 10, sensing bulbs 442 and 444 detect, respectively, inlet and outlet evaporator temperatures, the resultant differential pressure in the bellows 446 and 447 being a function of the degree of superheat of refrigerant flowing from the evaporator through the suction line 414. Effect of the differential, i.e., superheat, detected in this manner is transformed into operation of switch 445 to control heater 450. As the superheat increases above a predetermined value, switch 445 closes and heater 450 is energized. Heat introduced by heater 450, together with superheat in the evaporator outlet volatilizes liquid refrigerant in lower loop 428 and conduit portion 426. This lightens the column of liquid in conduit 426, causing it to rise to a height sufficient to effect flow outwardly of loop 424 and opening 424A to the inner wall of conduit 427. The diverted liquid refrigerant then subcools liquid refrigerant flowing through the main capillary tube restrictor 417A, thereby increasing the flow rate capacity of the latter. After a period of such heat exchange, this increased flow of refrigerant to the evaporator will restore the nonstarved condition of operation. Such condition is sensed by bulbs 442 and 444 as a reduction in superheat temperature sufficient to open switch 445, de-energizing heater 450 and thus halting flow of refrigerant to loop 424, etc.. It will be understood that in some instances the evaporator outlet heat exchange 432 can be omitted, because heater 450 and its control system will suffice.

From the foregoing it will be appreciated that the invention achieves improved versatile performance of capillary tube type refrigeration systems, and that the structural variations and the control options and modes of the specific embodiments described in the Figures are, within reason to those skilled in the art, mutually adaptable to the disclosed species.

While the idealized presentation of FIG. 3 exhibits typical subcooling lines derived from steady state conditions, it will be appreciated that, in systems embodying the invention, the capillary tube subcooling process is cyclic and/or transient. By way of example, to produce the high 60° subcooling value, a properly designed system may require vapor lift action only one-half to three-quarters of the time. At lesser subcooling values, the vapor lift is operational a correspondingly lesser time. Hence an actual system will inherently exhibit variable subcooling rates-versus-time that represent an average value commensurate with those of the steady state curves depicted on FIG. 3, for given suction and ambient temperature conditions of operation.

Note that, collectively, the embodiments described cause the liquid refrigerant which has been diverted or vapor lifted, subject to evaporator superheat, to be heat exchanged with the capillary tube at diverse points in a basic system. For example, in FIG. 9, heat exchange occurs at 425 upstream of the evaporator; in FIG. 6, heat exchange is via a conduit parallel to the evaporator at 236; and in FIG. 4, heat exchange is evident at 118 in the suction line per se. In each embodiment, the capillary tube could be shifted downstream toward the respective control devices (i.e. 419, 219, 119), and a non-restrictive tube (interposed the condenser and capillary) substituted in the aforementioned heat exchanges. This versatility, plus the versatility of vapor lift device configuration, accents the scope of the basic concept and is contemplated by the following claims.

I claim:

1. In a refrigeration system of the type including a compressor, a condenser, a first conduit including a capillary tube, an evaporator, and a second conduit connected in series refrigerant flow circuitry, the improvement comprising control means operable to vary the subcooling of liquid refrigerant caused to flow through said capillary tube to effect changes in flow therethrough, in response to changes in the superheat of gaseous refrigerant flowing from said evaporator, said control means comprising first and second upstanding tube sections having their upper and lower ends in fluid flow communication, said first tube section being provided with an inlet port for refrigerant from said first conduit, said first tube section also being provided with an outlet port disposed to feed liquid refrigerant to said evaporator, said second tube section being adapted for outlet communication at a level above said outlet port with means in heat exchange with said first conduit, and means operable to volatilize refrigerant for flow in said second tube section in response to evaporator superheat, whereby to effect an outflow of liquid refrigerant from said second tube section for the recited heat exchange.

2. A system according to claim 1, and characterized further in that the recited outlet of said second tube section comprises means disposed and adapted to direct liquid refrigerant caused to flow from said second tube section onto upper interior surfaces of said first tube section and in that the recited heat exchange comprises said first conduit disposed on the exterior of said first tube section.

3. A system according to claim 1, and characterized further in that the recited outlet communication of said second tube section comprises a refrigerant bypass passage disposed in fluid flow communication with said second conduit, and in that the recited heat exchange is afforded by disposition of said first conduit in heat exchange relation with said second conduit.

4. A system according to claim 1, and characterized further in that the recited outlet communication of said second tube section comprises a refrigerant bypass passage disposed in fluid flow communication with said second conduit, and in that the recited heat exchange is afforded by disposition of said first conduit in heat exchange relation with said refrigerant bypass passage.

5. A system according to claim 1, and characterized further in that said first and second upstanding tube sections are interconnected by upper and lower loop portions, and in that said means operable to volatilize refrigerant comprises disposition of said second conduit in the region of the outlet to the evaporator in heat exchange relation with said lower loop portion in the region of its connection to said second tube section.

6. A system according to claim 1, and characterized further in that said first and second tube sections are disposed substantially coaxially, said second tube section having an aperture providing the recited fluid flow communication between upper regions of said tube sections, said second tube section including a bell-shaped lower region having clearance with said first tube section in provision of the recited fluid flow communication between lower regions of said tube sections, and in that the recited means operable to volatilize refrigerant includes a portion of said second conduit disposed for heat exchange relation with liquid refrigerant below said bell-shaped region of said second tube section.

7. A system according to claim 1, and characterized further in that said means operable to volatilize refrigerant comprises electrical heater means disposed and adapted to develop gaseous refrigerant for flow in said second tube section, and means for selectively energizing and deenergizing said heater means, in accordance with the degree of superheat in refrigerant flowing from said evaporator, said last recited means including differential temperature sensing means for the inlet and for the outlet of said evaporator.

8. A system according to claim 7, and characterized further in that said sensing means comprises a pair of sensing bulbs and a pair of opposed bellows having fixed base portions and mutually movable adjacent portions, each bulb connected to one of said bellows, and a switch operable by said mutually movable bellows portions and effective to control energization and deenergization of said heater means.

9. For a vapor-compression refrigerating system of the type having an evaporator and conduit including a capillary tube restrictor for metering the flow of liquid refrigerant to said evaporator, flow control means comprising: first and second tube sections having upper and lower regions in fluid flow communication; said first tube section being provided with inlet port means through which liquid refrigerant from said conduit may be fed; said first tube section also being provided with outlet port means adapted to feed liquid refrigerant to said evaporator means; said second tube section being provided with outlet port means, at a level above said first recited outlet port means, communicating with means provided to effect heat exchange with said conduit, and means for volatilizing refrigerant in said second tube section to effect the recited outflow therefrom in accordance with superheat in refrigerant flowing from said evaporator.

10. In a refrigerating system of the kind having a compressor, a condenser, an evaporator, a suction line, and a conduit including a capillary tube connecting said condenser with said evaporator, the improvement comprising: flow control means interposed said conduit and said evaporator, said control means including diverter passage means through which liquid refrigerant may be caused to flow for heat exchange with said conduit, and vapor lift means energizable in accordance with evaporator superheat to effect refrigerant flow through said diverter passage means to subcool refrigerant flowing in said conduit, whereby to increase the refrigerant flow rate in said system and reduce said superheat.

11. A system in accordance with claim 10 and characterized further in that said diverter passage means leads to said suction line, and in that the recited heat exchange is afforded by disposition of said suction line in heat exchange relation with said conduit.

12. A system in accordance with claim 10 and including an accumulator disposed in said suction line.

13. A system in accordance with claim 10 and further characterized in that said vapor lift means is powered by an electric heater operable in accordance with evaporator superheat.

14. In a refrigerating system of the kind having a compressor, condenser high side, an evaporator, suction line low side, and a conduit including a capillary tube connecting said condenser with said evaporator, an improved refrigerant flow control comprising: refrigerant flow diverter means interposed said conduit and said evaporator; and refrigerant passage means adapted to receive liquid refrigerant from said diverter means, in response to evaporator superheat, and return spent gaseous refrigerant to said low side, the recited diverted refrigerant being caused to flow in heat exchange relation with said conduit and operable to subcool refrigerant flowing therein, whereby to increase the rate of refrigerant flow in said conduit.

15. A system in accordance with claim 14 and further characterized in that said passage means leads to said suction line.

16. A system in accordance with claim 14 and further characterized in that the outlet of said evaporator and a portion of said diverter means are disposed in heat exchange relation in provision of the recited operation of said diverter means in response to evaporator superheat.

17. A device for controlling refrigerant flow in a system having a compressor, a condenser, a conduit including a capillary tube, an evaporator, and a suction line in series circuitry, said device comprising: a configuration of tubular members arranged to develop a pair of coexisting liquid columns; means defining an inlet port through which a liquid-gaseous mixture may be fed from said conduit to said device; means defining an outlet port from which refrigerant may flow from said device to said evaporator; a passageway leading from said tubular members and adapted for heat exchange with said conduit; and means for applying thermal energy to said configuration to displace liquid from one of said columns toward said passageway.

18. A system in accordance with claim 16, and further characterized in that a portion of said conduit intermediate said condenser and said refrigerant flow diverter means is disposed in heat exchange relation with the outlet of said evaporator.

* * * * *

UNITED STATES PATENT AND TRADEMARK OFFICE

CERTIFICATE OF CORRECTION

PATENT NO. : 3,955,374

DATED : May 11, 1976

INVENTOR(S) : Elmer W. Zearfoss, Jr.

It is certified that error appears in the above-identified patent and that said Letters Patent are hereby corrected as shown below:

Column 1, line 31, "by the" should read -- from the -- ; and line 48, "a objective" should read -- an objective -- . Column 3, line 3, reference numeral "14" should read -- 15 -- . Column 4, line 38, "of accordance" should read -- in accordance -- . Column 5, line 10, "exchanage" should read -- exchange -- ; and line 60, "restrictor-to-suctionline" should read -- restrictor-to-suction-line -- . Column 6, line 9, "bellshaped" should read -- bell-shaped -- . Column 7, line 27, "aa" should read -- a -- ; and line 48, reference numeral "214" should read -- 217 -- . Column 9, beginning on line 4, the text "heat exchange relation with tube 426 in proximity of" should be deleted.

Signed and Sealed this

Seventh Day of September 1976

[SEAL]

*Attest:*

RUTH C. MASON
*Attesting Officer*

C. MARSHALL DANN
*Commissioner of Patents and Trademarks*